United States Patent [19]

Hadad

[11] Patent Number: 4,883,332

[45] Date of Patent: Nov. 28, 1989

[54] ARM-KNEE AND LEG GUARD FOR DESKS AND FILE CABINETS

[76] Inventor: Ronald E. Hadad, 1140 Mill Rd., Richmond, Va. 23231

[21] Appl. No.: 221,634

[22] Filed: Jul. 20, 1988

[51] Int. Cl.[4] ..... A47B 88/00

[52] U.S. Cl. ..... 312/330.1; 312/137; 312/194

[58] Field of Search ..... 312/194, 330 R, 137; 248/345.1

[56] References Cited

U.S. PATENT DOCUMENTS

| | | | |
|---|---|---|---|
| 3,260,491 | 7/1966 | Goode | 248/345.1 |
| 4,142,766 | 3/1979 | Swerbinsky | 248/345.1 |
| 4,184,724 | 1/1983 | Katz et al. | 248/345.1 |
| 4,268,097 | 5/1981 | Woodard | 312/137 |
| 4,370,373 | 1/1983 | Janicz | 248/345.1 |

*Primary Examiner*—Joseph FAlk

*Attorney, Agent, or Firm*—Richard C. Litman

[57] ABSTRACT

A retractable body guard assembly for preventing injuries to users and occupants caused by striking protruding edges and corners of open drawers of furniture. The body guard assembly includes a continuous band of resilient material covering the protruding surfaces of a furniture drawer and an associated track system mounted to the furniture frame and adapted to receive and guide the lateral sections of the band of resilient material. This assembly allows rectilinear displacement of the protective body guard and effectively provides cushioning against impact when the drawer is displaced in an open position.

7 Claims, 2 Drawing Sheets

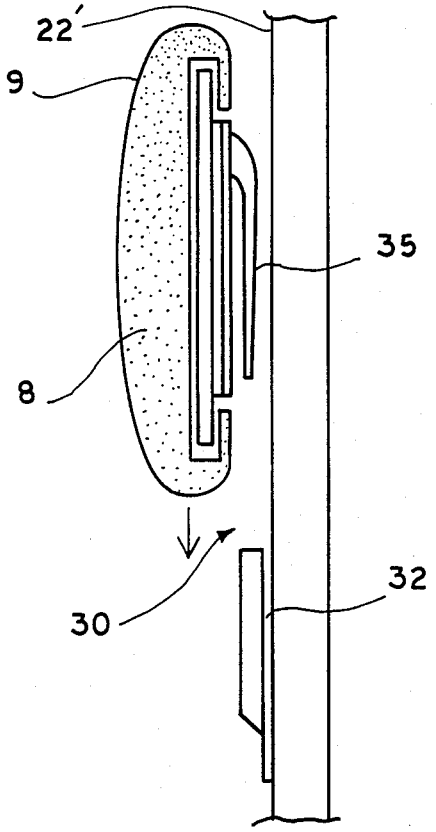
FIG. 3
FIG. 4
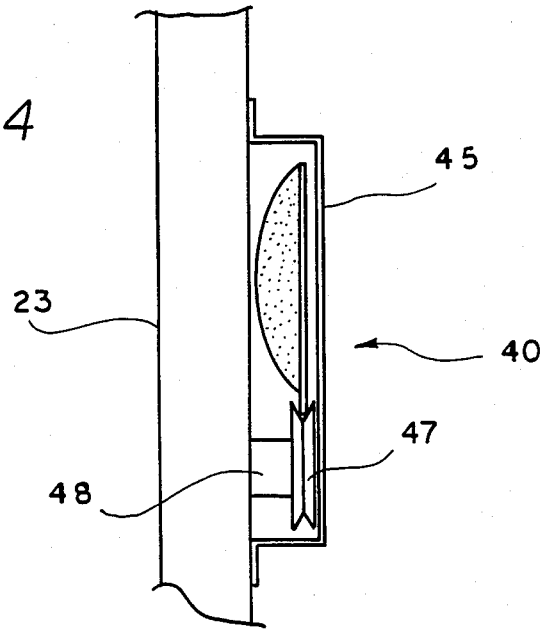

ARM-KNEE AND LEG GUARD FOR DESKS AND FILE CABINETS

BACKGROUND OF THE INVENTION

1. Field of the Invention

This invention relates generally to a drawer slide assembly for supporting a body guard formed of resilient material. More particularly, the invention pertains to a rectractable protective guard assembly mounted to the frame of furniture and drawers for preventing injuries to users and occupants caused by striking protruding edges and corners of open drawers of desks, file cabinets and the like.

2. Description of Related Art

It has heretofore been proposed to provide protective bumper devices which are intended to protect the edges and corners of furniture from damage and/or to safeguard persons against injury from impact with the areas covered by such devices. One such prior art device is described in U.S. Pat. No. 3,869,106, issued Mar. 6, 1975 to Gregov, which discloses a resilient trim type of edge guard applicable by adhesive and described as being especially useful for preventing injury to children on furniture such as a coffee table. The prior art likewise makes various disclosures concerning protecting individuals and furniture occupying dwelling places other than in the home. For example, U.S. Pat. No. 3,722,700, issued Mar. 27, 1973 to Cummings, discloses a C-shaped elastomeric corner pad for use on food service carts and U.S. Pat. No. 3,260,491, issued July 12, 1966 to Goode, descibes an attachable resilient corner cap for drawers and doors of office furniture or equipment, specifically of metal fabrication.

The aforementioned prior art protective devices are designed to be permanently secured in place on the furniture or equipment and fail to provide maximum protection to the user or occupant from protruding corners, as well as edges of furniture drawers when displaced in an opened position. It is not an infrequent occurrence for persons occupying an office environment to suffer painful if not more or less serious injury and bruises to limbs from accidental contact with sharp edges and corners of slidable desk or file cabinet drawers, intentionally or inadvertently left opened. However, permanently mounting protective padding of sufficient thickness along the protruding surfaces of the open drawer to prevent injury would substantially reduce the capacity of the drawer itself and obstruct the sliding mechanism of a drawer assembly within the cabinet opening.

It is accordingly a primary object of the present invention to provide a retractable body guard assembly for preventing injuries on impact with furniture drawers.

It is a further object of the present invention to provide a resilient body guard designed to be installed permanently on the furniture frame and retractably disposed within a drawer slide assembly and adapted to envelope exposed and dangerous areas of furniture drawers to protect occupants and users against injury by contact therewith.

It is amount the further objects of the present invention to provide a protective cushion for preventing injuries caused by striking protruding drawer corners and edges, which also complements the aesthetic appearance of furniture, is antifrictionally supported on a drawer slide assembly, and which does not reduce the capacity of the drawer itself or interfere with the normal sliding mechanism of the drawer assembly.

SUMMARY OF THE INVENTION

These and other objects are accomplished in accordance with the present invention by providing a body guard assembly for preventing injuries on impact with protruding surfaces of drawers. The body guard assembly is retractable and includes a furniture drawer having parallel, vertically disposed sides and a front side extending therebetween and a drawer cabinet having parallel, vertically disposed inner and outer surfaces. The retractable body guard assembly further comprises. two parallel elongated panels of resilient material extending longitudinally of the opposing upper edges and corners of a drawer and terminally joined to a transverse front panel of resilient material extending horizontally of the upper edge and corners of a frontal section of the drawer and securely fastened thereto. The body guard assembly further comprises an associated channel-like track system longitudinally mounted to a drawer cabinet frame and adapted to support and guide the two elongated panels. Upon rectilinear displacement of the drawer during an opening an closing operation, the elongated panels longitudinally slide relatively frictionlessly along parallel tracks to provide cushioning against possible impact when the drawer is displaced in an open position.

An advantageous feature of the present invention is a resilient protective guard which is retractable, durable and attractive in use and may be conveniently attached to most office furniture of permanently installed during manufacture to provide an aesthetically pleasing "built-in" feature of the furniture.

The foregoing and other features, advantages and objects of the invention may be more fully appreciated by reference to the following description.

BRIEF DESCRIPTION OF THE DRAWINGS

FIG. 3 is a side elevational view of an associated track system externally mounted to a furniture frame.

FIG. 4 is a side elevational view of an associated track system internally mounted to a furniture frame.

DETAILED DESCRIPTION OF THE ILLUSTRATIVE EMBODIMENTS

Figure 1:
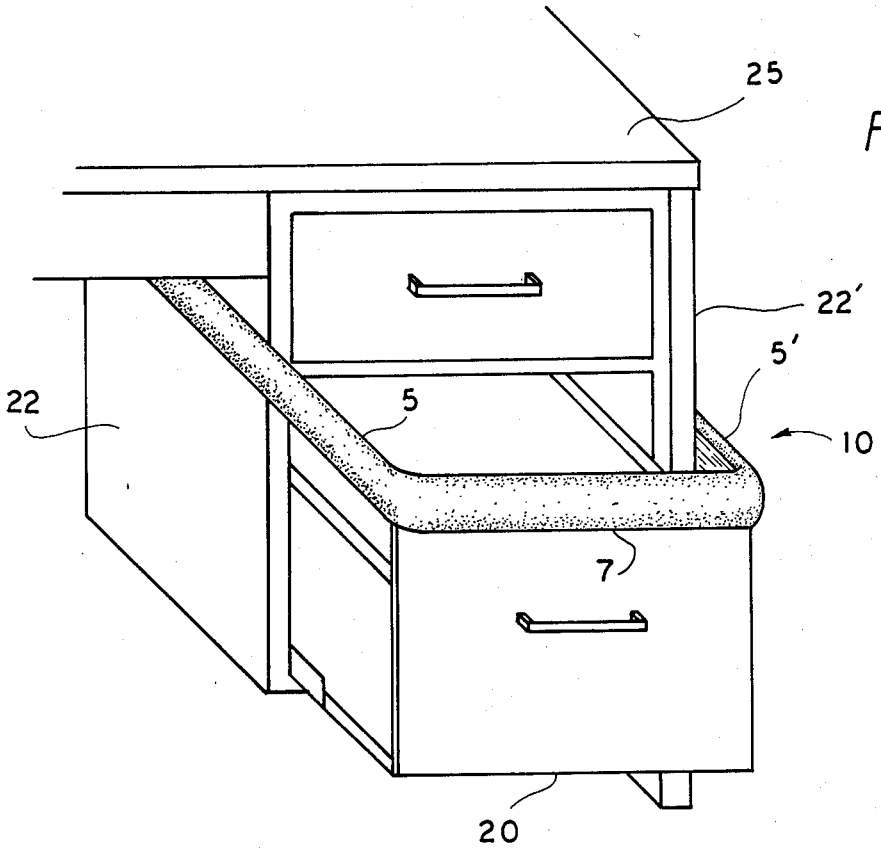
FIG. 1 is a fragmentary perspective view of the body guard assembly according to the present invention externally mounted to the frame of a desk.
Figure 2:
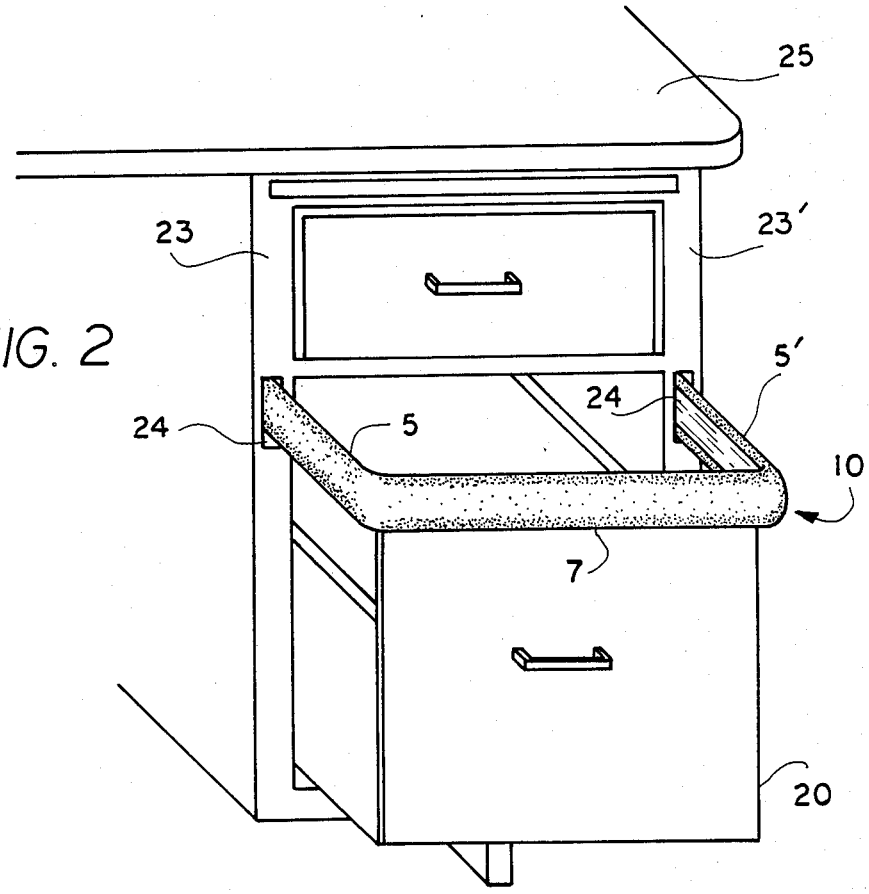
FIG. 2 is a fragmentary perspective view of the body guard assembly according to the present invention internally mounted within the frame of a desk.

The body guard assembly of the present invention, indicated generally as 10 in FIGS. 1 and 2, comprises two elongated panels 5 and 5', parallel each other, extending longitudinally of the opposing upper edges and corners of drawer 20. Panels 5 and 5' are terminally joined to a transverse front panel which extends horizontally along the upper edge and corners of the frontal section of drawer 20 and is fixedly secured thereto by screws or, preferably, adhesives. Panels 5, 5' and 7 may consist of a continuous band of soft, durable resilient material fabricated in various colors to enhance the appearance of office or home furniture. Preferably, the band of resilient material consists of a foam rubber cushion 8 enclosed in a decorative vinyl or leather covering 9, as best illustrated in FIG. 3.

The body guard assembly 10 may be externally mounted to the frame of desk 25 as shown in FIG. 1. Desk 25 is preferably of the "pedestal-type" construction wherein lateral sides 22 and 22' of the frame are exposed to conveniently permit mounting of the assembly and allow elongated panels 5 and 5' to be unobstructed during opening and closing of drawer 20. Alternatively, body guard assembly 10 may be internally mounted within the drawer frame of desk 25, in the manner generally shown in FIG. 2. The drawer frame includes vertical posts 23 and 23' having narrow openings 24 and 24' to receive elongated panels 5 and 5'. This "built-in" embodiment of the present invention is preferably installed at the factory during the manufacturing stage and offers an aesthetic appearance to a variety of office, as well as home furnishings containing slidable drawers.

Body guard assembly 10 further comprises an associated channel-like track system, indicated generally as 30 in FIG. 3 and 40 in FIG. 4. Track system 30 is preferably used in association with the external construction illustrated in FIG. 1 and comprises clip 32 and depending arm 35 insertable therein. Clip 32 is securely fastened adjacent lateral sides 22 and 22' of the frame of desk 25 by screwing or adhesive means, for example, and extends parallel opposing panels 5 and 5' (see FIG. 1). Depending arm 35 is permanently affixed to the interior surface of panels 5 and 5', extending longitudinally thereof, and slidingly engages clip 32 upon rectilinear displacement of the drawer on either opening or closing. The alternative track system 40 optionally used in association with the internal arrangement generally shown in FIG. 2 comprises sleeve runner 45 and roller 47 rotatably mounted on shaft 48. Sleeve runner 45 extends longitudinally from openings 24 and 24', and is fastened interiorly to the cabinet frame of desk 25 by any suitable fastening means. Roller 47 is suitably spaced within sleeve runner 45 to provide a plurality of roller arranged to receive opposing panels 5 and 5'. This arrangement allows the resilient panels to be frictionlessly guided along the plurality of rollers as the drawer opens and closes.

It should be understood that various changes and modifications can be made of the disclosure without departing from the spirt and scope of the invention. Accordingly, the foregoing illustrations are not to be interpreted as restrictive of the invention beyond that necessitated by the appended claims.

I claim:

1. A retractable body guard assembly for a furniture drawer having parallel, vertically disposed sides and a front side extending therebetween, said furniture drawer being enclosed in a drawer cabinet having parallel, vertically disposed inner and outer surfaces, said retractable body guard assembly comprising:

elongated panels of resilient material extending longitudinally adjacent said parallel, vertically disposed sides of the furniture drawer, said elongated panels are terminally joined to a transverse front panel of resilient material which extends horizontally adjacent said front side of the furniture drawer and securely fastened thereto; and an associated channel-like track system longitudinally mounted to either of the parallel, vertically disposed surfaces of said drawer cabinet and adapted to support and guide said elongated panels of resilient material, wherein upon rectilinear displacement of the furniture drawer the elongated panels of resilient material slide substantially frictionlessly along associated tracks to effectively provide cushioning against impact when said furniture drawer is displaced in an open position and to prevent injuries on impact with protruding surfaces of the furniture drawer.

2. The body guard assembly according to claim 1, wherein said associated channel-like track system is externally mounted to the outer surface of said drawer cabinet.

3. The body guard assembly according to claim 2, wherein said associated channel-like system comprises a clip securely fastened to the outer surface of said drawer cabinet and a depending arm insertable therein and affixed to the elongated panels of resilient material.

4. The body guard assembly according to claim 1, wherein said associated channel-like track system is internally mounted to the inner surface of said drawer cabinet.

5. The body guard assembly according to claim 4, wherein said associated channel-like track system comprises a sleeve runner interiorly fastened to the inner surface of said drawer cabinet and a plurality of suitably spaced rollers arranged to receive the elongated panels of resilient material.

6. The body guard assembly according to claim 4, wherein said transverse front panel of resilient material and adjoining elongated panels comprise a continuous band of foam rubber cushion enclosed in a decorative covering.

7. The body guard assembly according to claim 1, wherein said furniture drawer includes a desk drawer of a pedestal-type construction.

* * * * *